US006244165B1

(12) United States Patent
Trombley et al.

(10) Patent No.: US 6,244,165 B1
(45) **Date of Patent: *Jun. 12, 2001**

(54) INTEGRATED COOLING, HEATING FOOD PREPARATION SYSTEM

(75) Inventors: Joseph S. Trombley, 124 W. Midland Rd., Auburn, MI (US) 48611; Christopher John Rudy, Fort Gratiot Township, St. Clair County, MI (US)

(73) Assignee: Joseph S. Trombley, Auburn, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/374,683

(22) Filed: Aug. 16, 1999

Related U.S. Application Data

(60) Provisional application No. 60/096,785, filed on Aug. 17, 1998.

(51) Int. Cl.[7] ..... H05B 1/02

(52) U.S. Cl. ..... 99/331; 99/325; 99/470; 99/484; 219/679

(58) Field of Search ..... 99/325, 331, 470, 99/486, 484; 219/501, 506, 508, 494, 448, 452, 453, 679, 714; 340/825.06, 825.16, 825.17, 870.17, 870.21

(56) References Cited

U.S. PATENT DOCUMENTS

| | | | |
|---|---|---|---|
| 3,608,627 | 9/1971 | Shevlin | 165/2 |
| 4,097,709 | 6/1978 | Bä chtold et al. | 219/10.55 R |
| 4,156,454 | 5/1979 | Skala | 165/2 |
| 4,250,959 | 2/1981 | Spasojevic | 165/61 |
| 4,413,171 | 11/1983 | Klammers | 219/400 |
| 4,591,683 | 5/1986 | Eke | 219/10.55 B |
| 4,626,662 | 12/1986 | Woolf | 219/501 |
| 4,837,414 | 6/1989 | Edamula | 219/10.55 B |
| 4,881,590 | 11/1989 | Meier | 165/48.1 |
| 4,884,626 | 12/1989 | Filipowski | 165/12 |
| 5,201,364 | 4/1993 | Tippmann et al. | 165/26 |

(List continued on next page.)

OTHER PUBLICATIONS

VIVE Synergies Inc., TeleSwitch (TM): retrieved Aug. 15, 1999 (http://www.vive.com/vivesyn/catalog/p–telsw.htm).
GIZMOCITY.COM, Telephone Call–In–Control: retrieved Aug. 15, 1999 (http://www.electronicgizmos.com/cic.html).
USPTO Patent Bibliographic Database: Woolf(patent 4,626,662): abstract page Dec. 1986.
USPTO Patent Bibliographic Database: Edamula (patent 4,837,414): abstract page Jun. 1989.
USPTO Patent Bibliographic Database: Holling et al. (patent 5,321,229): abstract page Jun. 1994.
USPTO Patent Bibliographic Database: Kim (patent 5,931,010): abstract page Aug. 1999.
Brayton et al., U.S. provisional patent application No. 60/060,955 filed Oct. 6, 1997.
Trombley et al., U.S. provisional patent application No. 60/096,785 filed Aug. 17, 1998.

*Primary Examiner*—Reginald L. Alexander
(74) *Attorney, Agent, or Firm*—Christopher John Rudy; Andrew Joseph Rudy

(57) ABSTRACT

Integrated cooling, heating food preparation system has a food containing volume; a device to refrigerate food in that volume; a device to cook the refrigerated food in the same volume; and, optionally, a device to keep warm and/or refrigerate the cooked food in the same volume. The system is suitably controlled, preferably by remote control activation, for a few examples, through a public exchange computer communications system or by radio. The system can be embodied in a form in which the food containing/heating unit is placed in a pre-existing or modified refrigeration cabinet.

20 Claims, 3 Drawing Sheets

U.S. PATENT DOCUMENTS

| | | | | |
|---|---|---|---|---|
| 5,280,748 | | 1/1994 | Pardo | 99/330 |
| 5,321,229 | | 6/1994 | Holling et al. | 219/448 |
| 5,325,766 | | 7/1994 | Mareels | 99/357 |
| 5,351,745 | | 10/1994 | Park | 165/30 |
| 5,375,508 | * | 12/1994 | Knepler et al. | 99/280 |
| 5,401,940 | | 3/1995 | Smith et al. | 219/679 |
| 5,404,935 | | 4/1995 | Libermann | 165/48.1 |
| 5,421,246 | | 6/1995 | Tippmann et al. | 99/448 |
| 5,454,427 | | 10/1995 | Westbrooks et al. | 165/12 |
| 5,477,778 | | 12/1995 | Kuwahara | 99/483 |
| 5,477,915 | | 12/1995 | Park | 165/30 |
| 5,482,729 | | 1/1996 | McKenzie et al. | 426/635 |
| 5,503,300 | | 4/1996 | Prescott et al. | 221/273 |
| 5,522,310 | | 6/1996 | Black, Sr. et al. | 99/357 |
| 5,535,664 | * | 7/1996 | Rokowski | 99/331 |
| 5,566,856 | | 10/1996 | Fallen et al. | 221/150 HC |
| 5,655,595 | | 8/1997 | Westbrooks, Jr. | 165/48.1 |
| 5,674,425 | | 10/1997 | Hong | 219/681 |
| 5,771,959 | | 6/1998 | Westbrooks, Jr. et al. | 165/11.1 |
| 5,797,445 | | 8/1998 | Westbrooks, Jr. et al. | 165/11.1 |
| 5,931,010 | | 8/1999 | Kim | 62/157 |
| 5,949,412 | * | 9/1999 | Huntsman | 345/329 |
| 5,983,200 | * | 11/1999 | Slotznick | 705/26 |
| 6,032,574 | * | 3/2000 | Brayton et al. | 99/486 |

* cited by examiner

INTEGRATED COOLING, HEATING FOOD PREPARATION SYSTEM

CROSS-REFERENCE CLAIM OF DOMESTIC PRIORITY

This claims benefit under 35 USC 119(e) of U.S. provisional patent application No. 60/096,785 filed on Aug. 17, 1998 A.D.

FIELD

The present invention concerns a device which can keep food cool in a certain volume and heat it in the same volume, and methods to make and use the same.

BACKGROUND

Bodily health is a legitimate concern of which more and more persons are becoming conscious, and in the majority of cases, in keeping with the maxim, you are what you eat, good nutrition is a necessary foundation to good health. In addressing the problem, the sensible approach would be to prepare nutritious foods by cooking the raw food as from "scratch." However, as all too many people know by experience, today's fast-paced lifestyle can leave little time to prepare nutritious foods, and many persons resort to prepared foods, which require only heating, but of these, many are sorely deficient in adequate nutrition.

It would be desirable to be able to safely and efficiently prepare, in today's fast-paced lifestyles, nutritious foods. It would be further desirable to have flexibility in the same, and to be able to keep the food so prepared, before or even after its preparation, palatable and relatively safe from spoilage.

SUMMARY

The present invention provides, in one aspect, an integrated cooling, heating food preparation system, which comprises a food containing volume; a means to refrigerate food in said volume; a means to cook the refrigerated food in the same volume; and, optionally, a means to keep warm and/or refrigerate the cooked food in the same volume. The system is suitably controlled, in a preferred embodiment by remote control activation. In other aspects, methods of making and using the same are provided.

The invention is useful in food preparation.

Significantly, by the invention, nutritious foods such as raw chicken and fish can be kept safe and cool during the day even when the busy person is away from the kitchen, and ready for cooking, and then cooked automatically or activated remotely. The busy person can thus enjoy nutritious and most palatable foods at the end of a busy work day, safely and with a minimum of effort. The invention is economical in making and use, and numerous further advantages attend it.

DRAWINGS

The drawings form part of the specification hereof. With respect to the drawings, the following is briefly noted:

Figure 1:
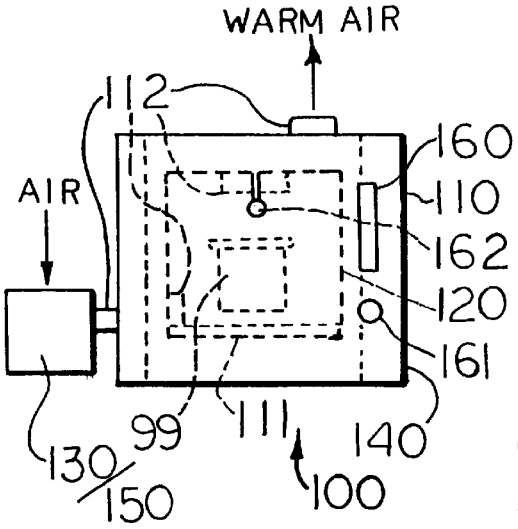
FIG. 1 is a front plan view of an integrated cooling, heating food preparation system of the present invention, employing microwave heating and integral control panel activation features.
Figure 2:
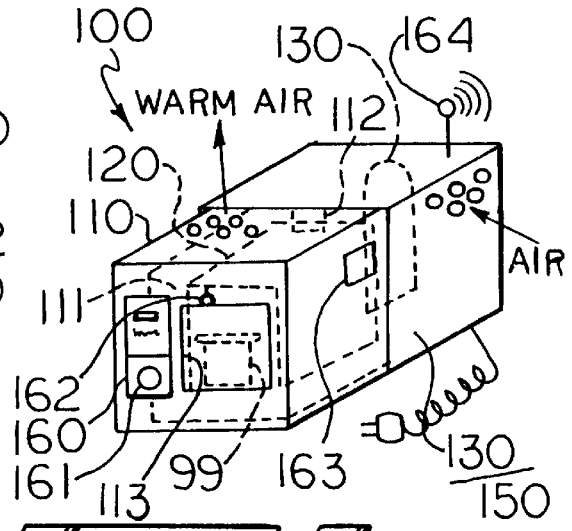
FIG. 2 is a front, top, perspective, plan view of another embodiment of the invention, employing microwave and/or convection heating and radio control activation features.
Figure 3:
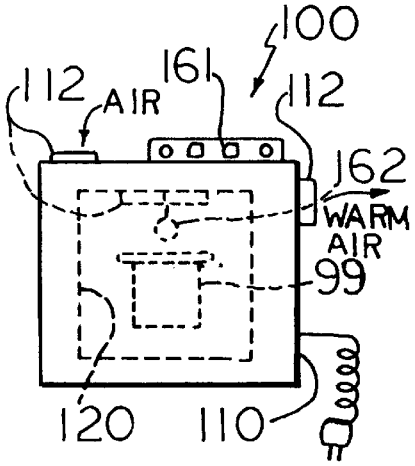
FIG. 3 is a front plan view of another embodiment of the invention, employing conventional heating and external control box activation features.
Figure 4:
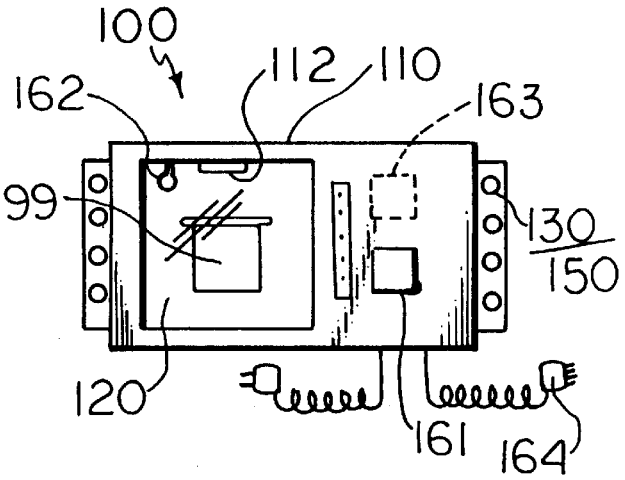
FIG. 4 is a front plan view of another embodiment of the invention, employing microwave heating and telephone/computer line control connection activation features.
Figure 5A:
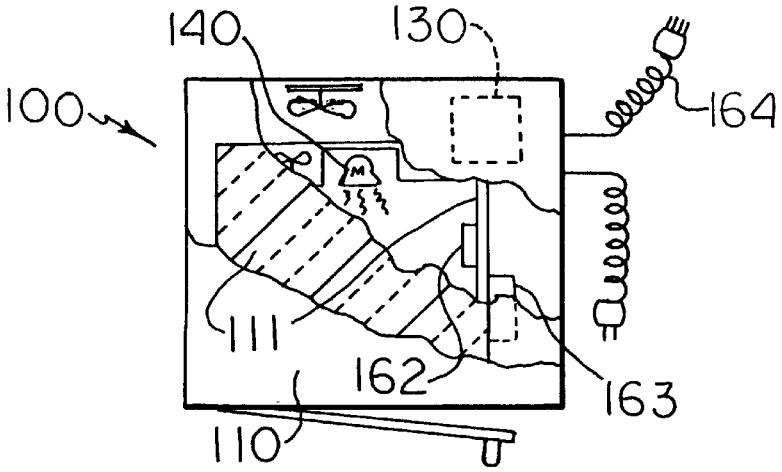
Figure 5B:
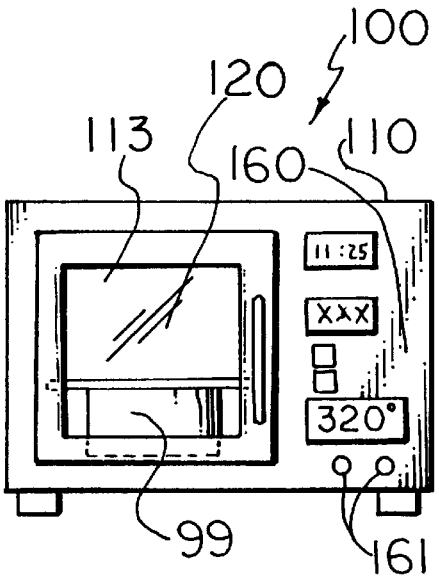
Figure 5C:
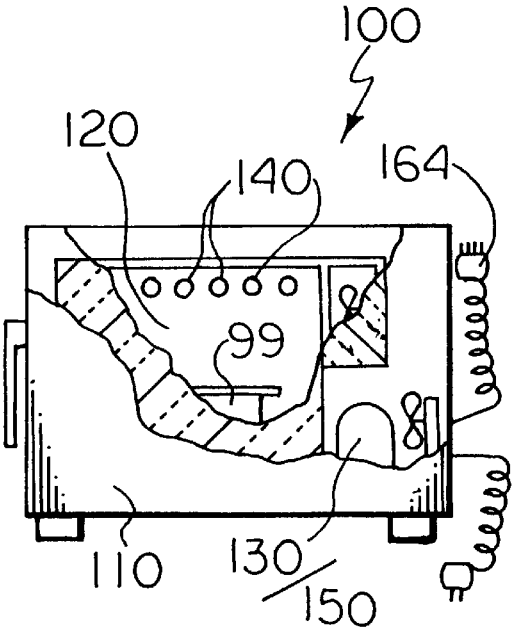

FIG. 5 comprises top, partial cut away; front, and side, partial cut away plan views (FIGS. 5A; 5B, and 5C, respectively) of another embodiment of the invention, which employs microwave and/or conventional heating and telephone/computer line control activation features.

Figure 6:
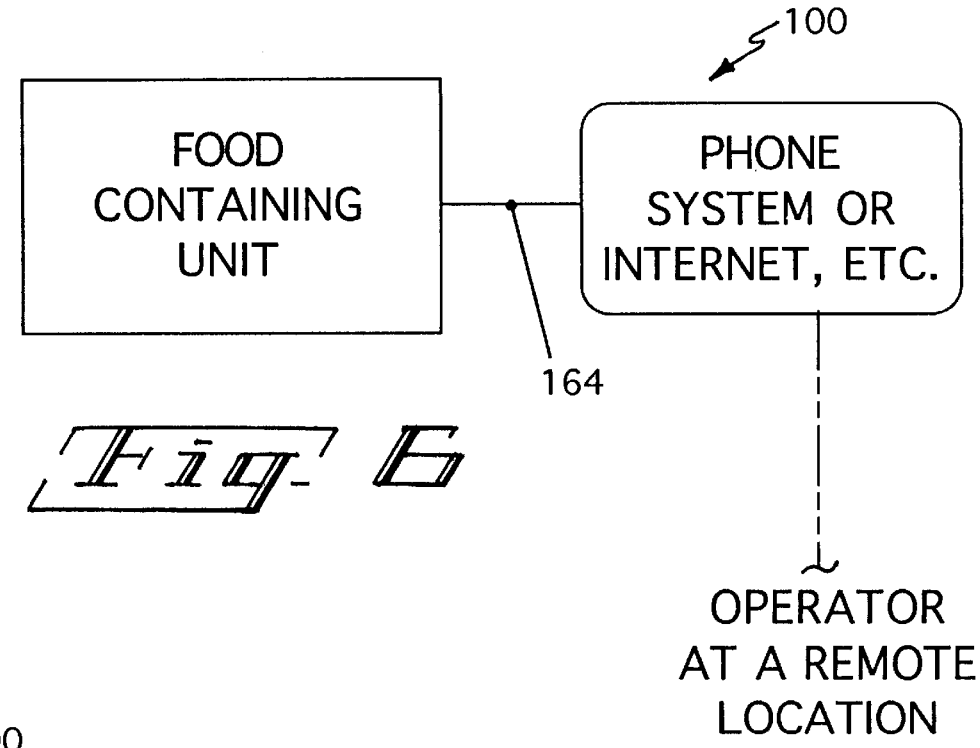

FIG. 6 is a schematic representation of another embodiment of the invention, having remote activation and control using a communications system.

Figure 7:
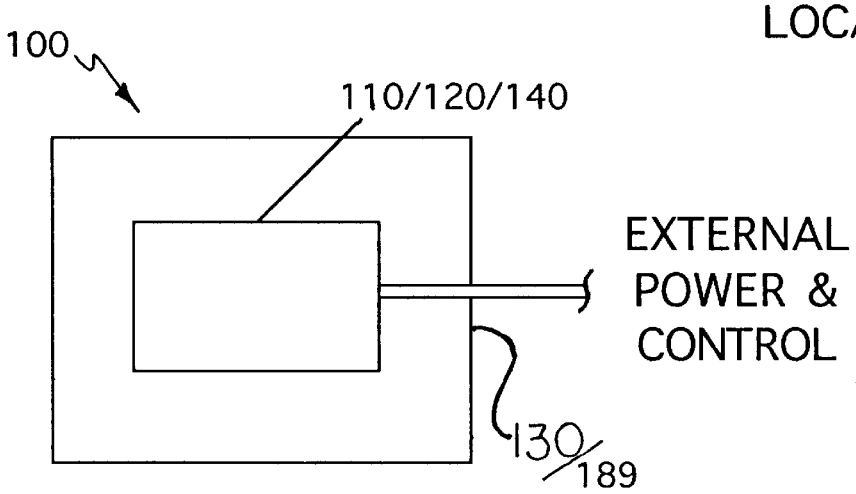

FIG. 7 is a plan view of another embodiment of the invention, in which the food containing/heating unit is in a pre-existing or modified refrigeration cabinet.

ILLUSTRATIVE DETAIL

The invention can be further understood by reference to the present detail, which may be read in view of the drawings. The same is to be taken in an illustrative and not necessarily limiting sense.

The complete specification of the aforesaid U.S. provisional patent application is incorporated herein by reference.

In general, with reference to the drawings, integrated cooling, heating food preparation system 100 includes housing 110 which encloses food containing volume 120. Food 99 in the volume 120 is refrigerated by means 130 to refrigerate the food 99 in the volume 120, and is cooked by means 140 to cook the refrigerated food 99 in the volume 120. Optionally, the cooked food may be kept warm and/or cold by means 150 keep warm and/or refrigerate the cooked food 99 in the volume 120. The system 100 may include controls 160, which may be manual but preferably are electronic.

The system 100 may employ conventional gas, halocarbon, liquid, gel, solid (including ice-pack) or electronic solid-state (to include well known ferro-electric units which operate by the Peltier effect) cooling as the means 130, and microwave, conventional convection, conduction and/or radiation oven technology (to include the same ferro-electric units which operate by the Peltier effect) as the means 140, for which the housing 110 is suitable adapted, for example, with insulation 111. Generally, although not necessarily, the cooling means 130 is provided outside of the volume 120. Vents 112 may remain closed during refrigeration cycles, for example, and open during cooking/heating cycles. Observation window 113 may be present. In a microwave model, perforated metal wall 114 shields cooling system from electromagnetic radiation such as from magnetron 140.

The controls 160 may include employment of an indicator 161, which may be a chart or preferably an alarm, with respect to the food 99 or volume 120 having been kept adequately cool before the cooking, for example, to avoid Salmonella, and so forth, and the indicator 161 may be hooked up with sensor 162 in the volume 120 and microprocessor 163 outside of it. The indicator 161, for example, the alarm, would be activated, e.g., by emission of visible light and/or audible sound, if the temperature has risen over a predetermined threshold for a predetermined time, as determined by the sensor 162 and microprocessor 163. The sensor 162 and microprocessor 163 may optionally be arranged to control refrigeration cycles, for example, by thawing the food 99 from freezing level temperatures to refrigerator level temperatures, and, as well, to control the cooking cycle, and optional post-cooking cycles such as warming of the cooked food 99 for a predetermined time followed by refrigeration of the warmed food 99 indefinitely, if the food 99 has not been removed from the oven volume 120. Activation of the system 100 through the controls 160, to include the sensor 162 and microprocessor 163, may be by manual setting such as by use of a timer integral with the system 100 or by remote control 164 to include use of the telephone, whether wired or wireless, the home computer, and the Internet, with which the system 100 can be connected. As an alternative, the controls 160 may be remote control 164 activated by a personal, separate remote radio control device akin to a garage door opener. Thus, for example, a man may have a busy, variable schedule, and remotely activate the cooking cycle only when he is ready to leave work through, say, the Internet. Completing his commute, he finds his chicken meal completely cooked in the system 100 to his satisfaction, and he masticates the fowl with pleasure. Following his meal, he may place the next evening's food 99 in the system 100, which refrigerates it overnight and until it is ready to be cooked.

For example, in FIG. 6 is depicted such a system 100. The food containing unit is essentially that depicted as in FIGS. 1–5 or otherwise known or developed in the art such as disclosed by Filipowski, U.S. Pat. No. 4,884,626 (Dec. 5, 1989), the complete specification of which is incorporated herein by reference. Any suitable remote control system or subsystem may be utilized in conjunction with a suitable communications system. The communications system can be existing or specifically adapted for use with the invention. For example, an existing telephone line or wireless phone connection may be employed; or a pager like device may be used to serve as a communication link between the remote operator and the food containing unit. Examples of remote telephone activation and control devices which can be employed according to the concepts of the invention include the well known TeleSwitch (Tm) programmable automatic switching device, or any other telephone control unit. These or similar units can be adapted to interface with the food containing unit. Thus, the connection 164 can be to a phone line system, a computer connection, and can include cellular and wireless connections.

As depicted in FIG. 7, the food containing unit(s) 110/120 can also be the heating portion of the system placed in a pre-existing or modified refrigeration cabinet 130/189. This combination device 100 provides for increased convenience, with the heating and/or cooling unit intimately adjacent or within the larger refrigeration cabinet with its more abundant refrigerated food stores. Air flow for cooling the unit is controlled by dampers or similar means, and/or forced air and/or liquid to prevent undesirable heat load of the refrigeration cabinet.

Accordingly, the invention may embrace the following embodiments, in general:

1. An integrated cooling, heating food preparation system, which includes a food containing volume; a means to refrigerate food in that volume; and a means to cook the refrigerated food in the same volume, wherein remote control activation of the cooking means is provided.

2. The system of the 1st embodiment, wherein the remote control activation is through use of a telephone system.

3. The system of 1st embodiment, wherein the remote control activation employs a connection through a public exchange computer communications system, i.e., the Internet.

4. The system of the 1st embodiment, wherein the remote control activation is provided by a wireless system.

5. The system of the 1st embodiment, wherein a means to keep warm and/or refrigerate the cooked food in the same volume is provided.

6. The system of the 5th embodiment, wherein the remote control activation is through use of a telephone system.

7. The system of the 5th embodiment, wherein the remote control activation employs a connection through a public exchange computer communications system, i.e., the Internet.

8. The system of the 5th embodiment, wherein the remote control activation is provided by a wireless system.

9. The system of the 1st embodiment, wherein the system resides in a larger refrigeration cabinet, or therewith.

The device or system of the invention can be made by known methods, as recognized by persons skilled in the art. Generally, many of the components are commercially available and adaptable for employment in the device or system of the invention.

To use the device or system of the invention, the same is set up on site by standard procedures. To actively operate the device or system, one may need only operate a minimal amount of controls as noted more fully hereinabove.

CONCLUSION

The present invention is thus provided. Various features, subcombinations, and combinations can be practiced with or without reference to other features, subcombinations, or combinations of the invention, and numerous adaptations and modifications can be effected within its spirit, the literal claim scope of which is particularly pointed out as follows:

We claim:

1. An integrated cooling, heating food preparation system useful for preparing a masticatable, solid food and being remotely activated through a public exchange computer communications system, which comprises a food-containing volume; a means to refrigerate food in said volume; and a means to cook the refrigerated food in the same volume, wherein the food is capable of being the masticatable, solid food, and means for activation from a remote location of the means to cook said food is provided by employing a connection through the public exchange computer communications system.

2. The system of claim 1, wherein a means to keep warm and/or refrigerate the cooked food in the same volume is provided.

3. The system of claim 1, wherein the means to cook said food is provided by microwave.

4. The system of claim 3, wherein a means to keep warm and/or refrigerate the cooked food in the same volume is provided.

5. In combination, an integrated cooling, heating food preparation system, which comprises a food-containing volume; a means to refrigerate food in said volume; and a means to cook the refrigerated food in the same volume, wherein means for activation from a remote location of the means to cook said food is provided; and a larger refrigeration cabinet in which at least a part of said system resides.

6. The combination of claim 5, wherein said system resides fully inside the larger refrigeration cabinet, and the means to cook said food is provided by microwave.

7. The combination of claim 5, wherein the means for activation from a remote location is through use of a telephone system.

8. The combination of claim 6, wherein the means for activation from a remote location is through use of a telephone system.

9. The combination of claim 5, wherein the means for activation from a remote location employs a connection through a public exchange computer communications system.

10. The combination of claim 6, wherein the means for activation from a remote location employs a connection through a public exchange computer communications system.

11. The combination of claim 5, wherein the means for activation from a remote location is provided by a wireless system.

12. The combination of claim 11, wherein the wireless system is provided by radio control.

13. The combination of claim 5, wherein a means to keep warm and/or refrigerate the cooked food in the same volume is provided.

14. The combination of claim 6, wherein a means to keep warm and/or refrigerate the cooked food in the same volume is provided.

15. The combination of claim 9, wherein a means to keep warm and/or refrigerate the cooked food in the same volume is provided.

16. The combination of claim 10, wherein a means to keep warm and/or refrigerate the cooked food in the same volume is provided.

17. A home-scale integrated cooling, heating food preparation system useful for handling food in a kitchen of a home and being remotely activated through a public exchange computer communications system, which comprises a home-scale food-containing volume suitable for handling food in the kitchen of the home; a means to refrigerate the food in said volume; and a means to cook the refrigerated food in the same volume, wherein means for activation from a remote location of the means to cook said food is provided by employing a connection through the public exchange computer communications system.

18. The system of claim 17, wherein a means to keep warm and/or refrigerate the cooked food in the same volume is provided.

19. The system of claim 17, wherein the means to cook said food is provided by microwave.

20. The system of claim 19, wherein a means to keep warm and/or refrigerate the cooked food in the same volume is provided.

* * * * *

Adverse Decision In Interference

Patent No. 6,244,165, Joseph S. Trombley, Christopher John Rudy, INTEGRATED COOLING, HEATING FOOD PREPARATION SYSTEM, Interference No. 105,144, final judgment adverse to the patentees rendered November 28, 2003, as to claims 1-4, and 17-20.

*(Official Gazette April 20, 2004)*